US006719333B2

(12) United States Patent
Rice et al.

(10) Patent No.: US 6,719,333 B2
(45) Date of Patent: Apr. 13, 2004

(54) VEHICLE DOOR LATCH WITH POWER OPERATED RELEASE MECHANISM

(75) Inventors: John R. Rice, Chesterfield, MI (US); Lloyd Walker Rogers, Jr., Shelby Township, MI (US)

(73) Assignee: Delphi Technologies, Inc., Troy, MI (US)

( * ) Notice: Subject to any disclaimer, the term of this patent is extended or adjusted under 35 U.S.C. 154(b) by 6 days.

(21) Appl. No.: 09/843,266

(22) Filed: Apr. 25, 2001

(65) Prior Publication Data

US 2002/0158475 A1 Oct. 31, 2002

(51) Int. Cl.[7] ..... E05C 3/06
(52) U.S. Cl. ..... 292/216; 292/201; 292/DIG. 23
(58) Field of Search ..... 292/216, 201, 292/DIG. 23, 199

(56) References Cited

U.S. PATENT DOCUMENTS

| | | | | |
|---|---|---|---|---|
| 3,380,771 A | | 4/1968 | Rogers, Jr. | |
| 4,005,887 A | * | 2/1977 | Itakura | 292/216 |
| 4,518,181 A | * | 5/1985 | Yamada | 292/201 |
| 4,756,563 A | | 7/1988 | Garwood et al. | |
| 4,763,936 A | * | 8/1988 | Rogakos et al. | 292/201 |
| 5,054,827 A | | 10/1991 | Konchan et al. | |
| 5,639,130 A | * | 6/1997 | Rogers et al. | 292/199 |
| 5,649,726 A | * | 7/1997 | Rogers et al. | 292/201 |
| 5,802,894 A | * | 9/1998 | Jahrsetz et al. | 70/264 |
| 5,918,917 A | * | 7/1999 | Elton et al. | 292/201 |
| 6,010,165 A | | 1/2000 | Santarelli et al. | |
| 6,027,148 A | * | 2/2000 | Shoemaker | 292/216 |
| 6,053,542 A | * | 4/2000 | Ostrowski et al. | 292/201 |
| 6,067,826 A | * | 5/2000 | Holloway et al. | 70/278.3 |
| 6,076,868 A | * | 6/2000 | Roger et al. | 292/199 |
| 6,102,454 A | * | 8/2000 | Weyerstall | 292/201 |
| 6,371,536 B1 | * | 4/2002 | Koerwer et al. | 292/201 |
| 6,386,599 B1 | * | 5/2002 | Chevalier | 292/201 |

* cited by examiner

*Primary Examiner*—J. J. Swann
*Assistant Examiner*—Thomas Ho
(74) *Attorney, Agent, or Firm*—Scott A. McBain

(57) ABSTRACT

A vehicle door latch has a power operated release mechanism for moving a detent from a latched position to a release position comprising a slide that engages the detent at one end and a rotary cam that engages an opposite end of the slide sot that the slide reciprocates when the rotary cam is rotated by an electric motor. The electric motor drives the cam via a concentric gear wheel that has a pin engaging the rotary cam. A forkbolt rotates a rotary block out lever from a by-pass position to a block out position where the block-out lever engages a shoulder of the gear wheel to stop rotation of the gear wheel when the forkbolt is moved to an unlatched position. The vehicle door latch also includes a mechanical override mechanism to rotate the rotary cam to unlatch the vehicle door latch.

7 Claims, 4 Drawing Sheets

VEHICLE DOOR LATCH WITH POWER OPERATED RELEASE MECHANISM

This invention relates to vehicle door latches and more particularly to a vehicle door latch having a power operated release mechanism.

BACKGROUND OF THE INVENTION

An automotive closure, such as a door for an automobile passenger compartment, is hinged to swing between open and closed positions and conventionally includes a door latch that is housed between inner and outer panels of the door. The door latch functions in a well known manner to latch the door when it is closed and to lock the door in the closed position or to unlock and unlatch the door so that the door can be opened manually.

U.S. Pat. No. 4,756,563 granted to Stephen K. Garwood et al Jul. 12, 1988, which is hereby incorporated by reference, discloses a vehicle door latch that has a fork bolt and a spring biased detent that holds the forkbolt in a latched position. The spring biased detent is moved by a manually operated release mechanism that includes an intermittent lever that is pivotally attached to the detent in a depending relationship. The release mechanism further includes a pivotally mounted transfer lever that cooperates with a generally perpendicular tab at the bottom of the intermittent lever. The transfer lever is operated by an inside unlatching lever connected to an inside door handle of the like. When the inside door handle or its equivalent rotates the inside unlatching lever, the intermittent lever is pulled down by the transfer lever moving the detent to a release position where the fork bolt is released allowing the vehicle door to be opened from inside the vehicle.

The release mechanism also includes an outside unlatching lever that is connected to an outside door handle. When the outside door handle or its equivalent rotates the outside unlatching lever, the intermittent lever is pulled down by the transfer lever moving the detent to the release position where the fork bolt is released allowing the vehicle to be opened from inside the vehicle.

The door latch also has a lock mechanism that includes a pivotally mounted lock lever that is connected to the intermittent lever by a pin and slot arrangement. The lock lever is operated by an inside lock lever and an outside lock lever that move the lock lever and the intermittent lever between locked and unlocked positions. The door latch is locked by moving the lock lever and the intermittent lever to the locked position where the tab of the intermittent lever is bypassed by the transfer lever when the transfer lever attempts to unlatch the door latch.

The door latch disclosed in the Garwood '563 patent which is suitable for its intended purpose, is typical of the conventional approach of having a mechanically operated release mechanism and an independent mechanically operated lock mechanism. The lock mechanism is also power operated in upscale vehicles.

SUMMARY OF THE INVENTION

The vehicle door latch of the invention has a power operated release mechanism rather than a mechanically operated release mechanism that is typical of the prior art. The power operated release mechanism eliminates the need for an independent lock mechanism since the vehicle door latch is locked simply by cutting off power to the power operated release mechanism. The vehicle door latch of the invention preferably includes a mechanical override to unlatch the door in the event of a power failure.

Objects, features and advantages of the invention will become apparent from the description below, which is given by way of example with reference to the accompanying drawings.

DESCRIPTION OF THE PREFERRED EMBODIMENT

Figure 4A:
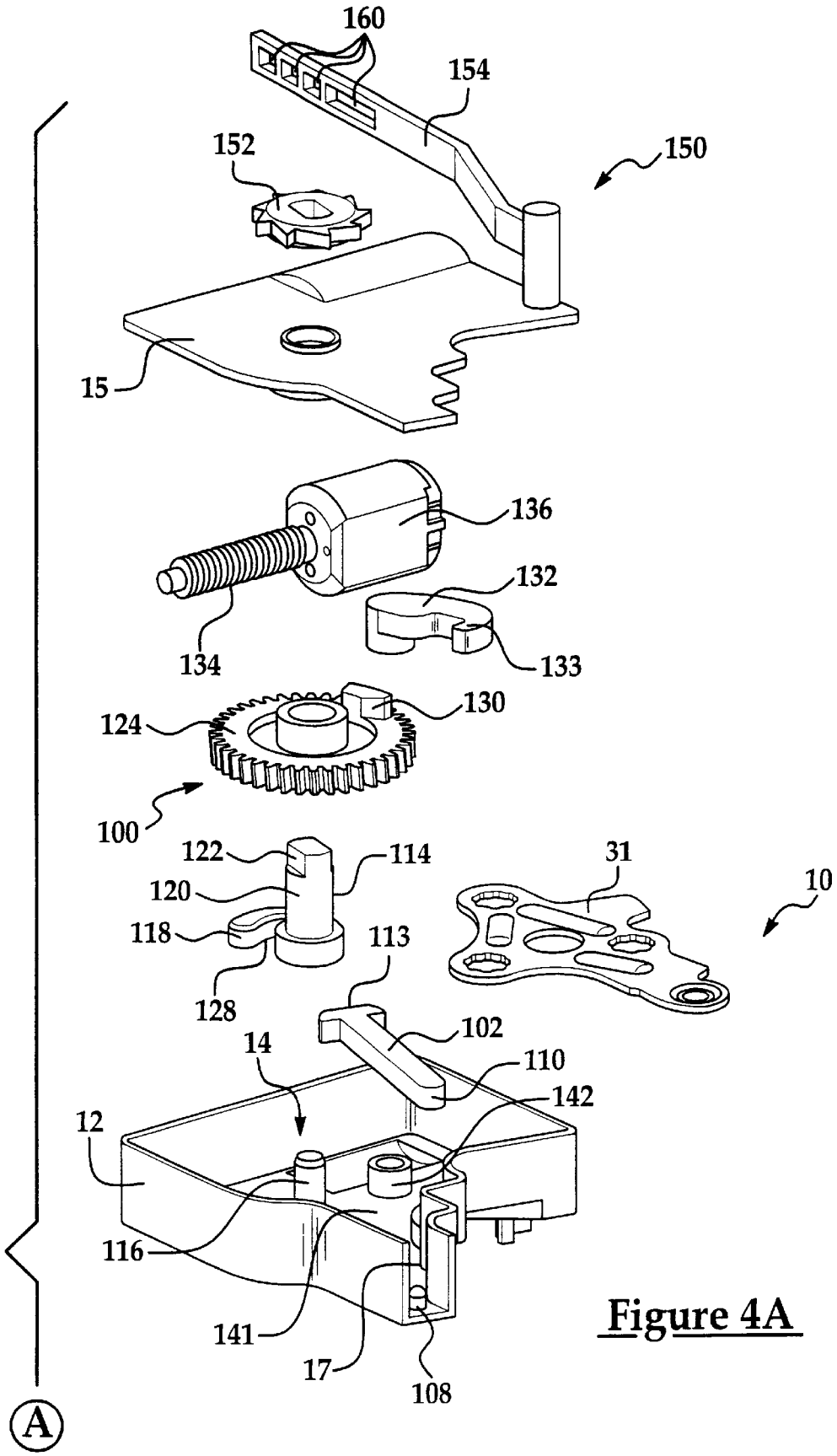
FIGS. 4A and 4B together are an exploded isometric view of the vehicle door latch shown in FIGS. 1, 2 and 3.
Figure 4B:
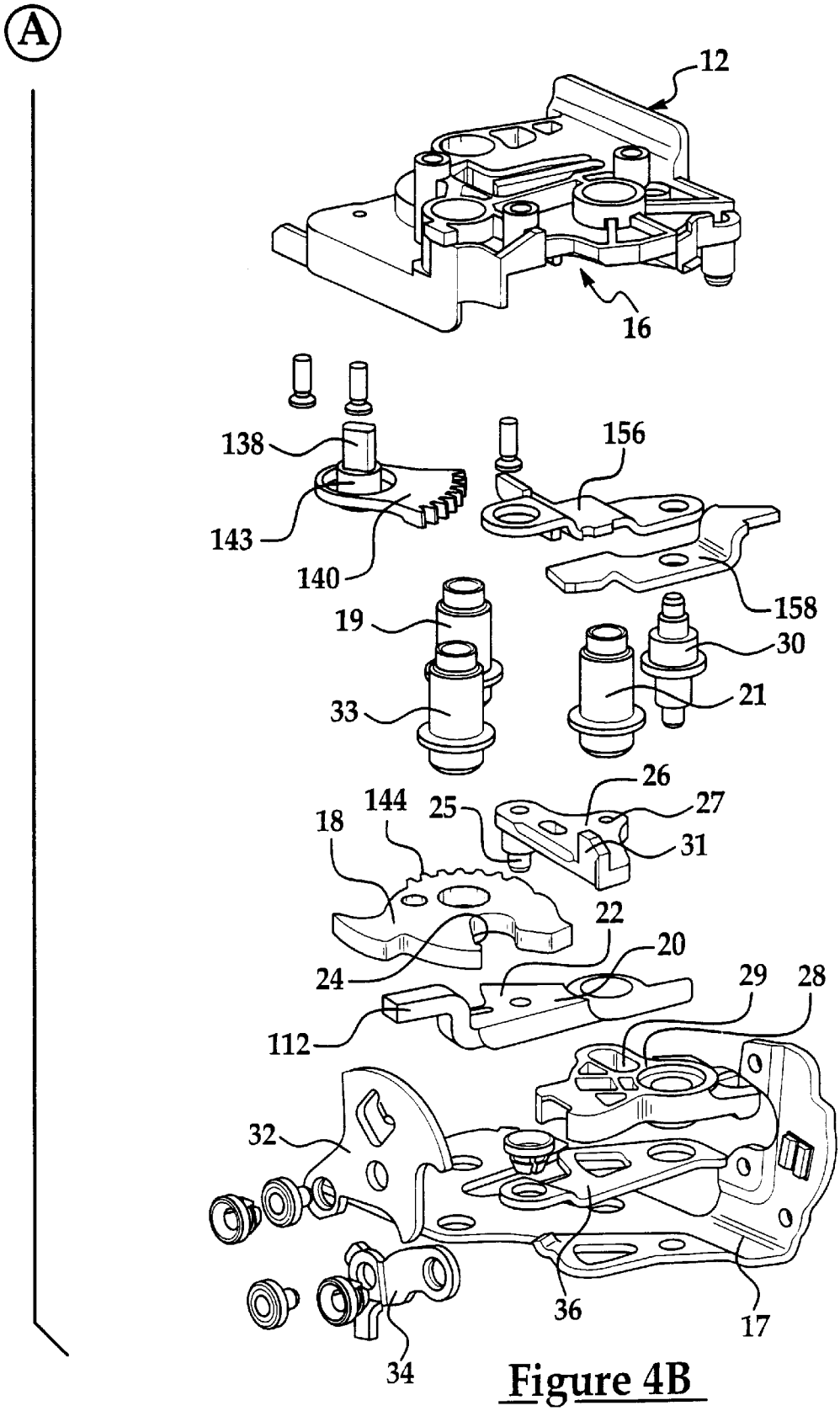

Vehicle door latch 10 comprises a two-piece plastic housing 12 that provides an upper chamber 14 and a lower chamber 16 that is closed by a frame 17 as best shown in FIGS. 4A and 4B. The lower chamber 16 contains the components of a conventional type of vehicle door latch that is manually operated, such as the vehicle door latch that is known from U.S. Pat. No. 4,756,563 granted to Stephen K. Garwood et al Jul. 12, 1988 discussed above.

Figure 5:
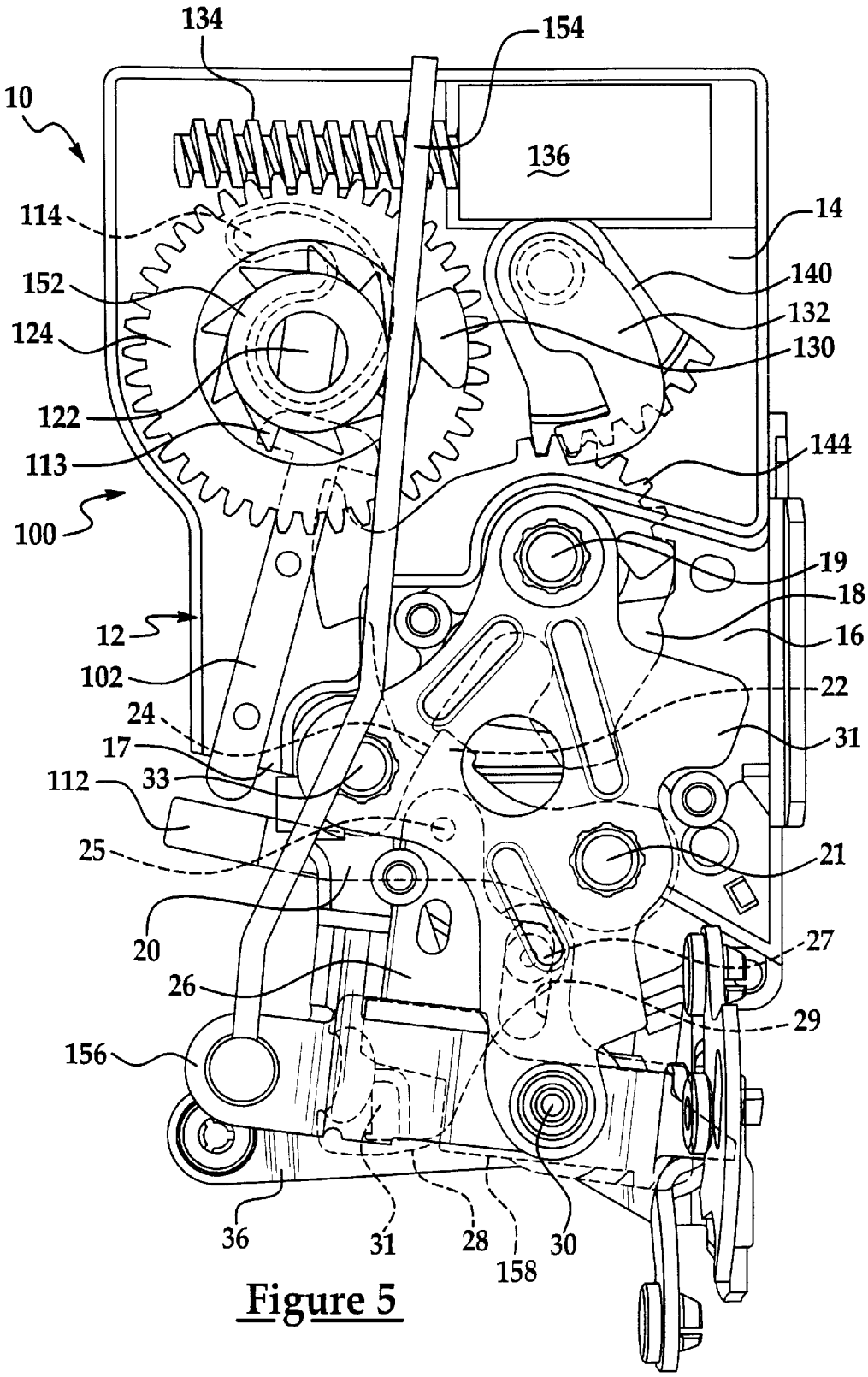
FIG. 5 is a front view of the vehicle door latch with parts removed to show internal detail.

In reference to FIGS. 4B and 5, this type of door latch includes a forkbolt 18 that pivots on a pivot pin 19 between a latched position and an unlatched position and a detent 20. Detent 20 pivots about a pivot pin 21 between a latched position holding the forkbolt in the latched position and a release position allowing the forkbolt to move to the unlatched position. Fork bolt 18 and detent 20 are shown in the latched position in FIG. 5. The unlatched position of fork bolt 18 (not shown) is about 40° counterclockwise from the latched position. The release position of detent 20 (not shown) is about 20° counterclockwise from the latched position. Forkbolt 18 is spring biased toward the unlatched position (counter-clockwise in FIG. 5) by a forkbolt spring that is removed in FIG. 5 for clarity. Forkbolt 18 is held in the latched position against the action of the forkbolt spring by catch 22 of detent 20 engaging latch shoulder 24 of forkbolt 18. Detent 20 is spring biased toward the latched position (clockwise in FIG. 5) by a detent spring that is removed in FIG. 5 for clarity.

The known portion of door latch 10 further includes an intermittent lever 26 that is pivotally connected to detent 20 in a depending relationship by a pivot pin 25 and also operatively connected to a lock lever 28 by a pin 27 that slides in a slot 29 of lock lever 28 so that lock lever 28 swings the intermittent lever 26 between an unlocked position and a locked position about pivot pin 25 when lock lever 28 is rotated between an unlocked position and a locked position about pivot pin 30. Pivot pin 30 is supported at opposite ends by frame 17 and brace 31 that is attached to housing 12 by pivot pins 19 and 21 and a third pin 33.

When intermittent lever 26 is in the unlocked position shown in FIG. 5, an inside unlatching lever 32 or an outside unlatching lever 156 engages tab 31 of intermittent lever 26 via a pivotal transfer lever 158 and pulls the intermittent lever 26 down to rotate detent 20 counter-clockwise to the release position which allows fork bolt 18 to rotate counter-clockwise to the unlatched position.

When intermittent lever 26 is pivoted clockwise from the unlocked position shown in FIG. 5 to the locked position (not shown), the pivotal transfer lever 158 by-passes tab 31 of intermittent lever 26 so that the detent 20 remains in the latched position holding fork bolt 18 in the latched position. An inside locking lever 34 or an outside locking lever 36 operates the lock lever 28 to move the lock lever 28 between the locked and unlocked positions to move the intermittent lever 26 between its locked and unlocked positions. These types of door latches are well known so that further details of construction and operation are not necessary. However, details of construction and operation of a typical door latch of the type housed in the lower chamber 16 can be had from the Garwood '563 patent cited above, which is has been incorporated in this patent specification by reference.

An important feature of this invention is the inclusion of a power operated release mechanism 100 for moving the detent 20 from the latched position shown in FIG. 5 to the release position (not shown) which is about 20° counter-clockwise from the latched position shown.

Figure 3:
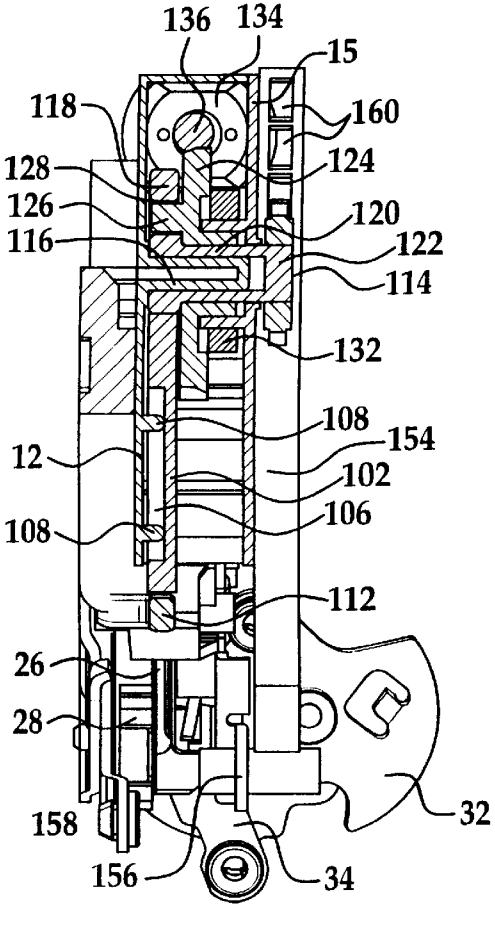
FIG. 3 is a section taken substantially along the line 3—3 of FIG. 2 looking in the direction of the arrows.
Figure 2:
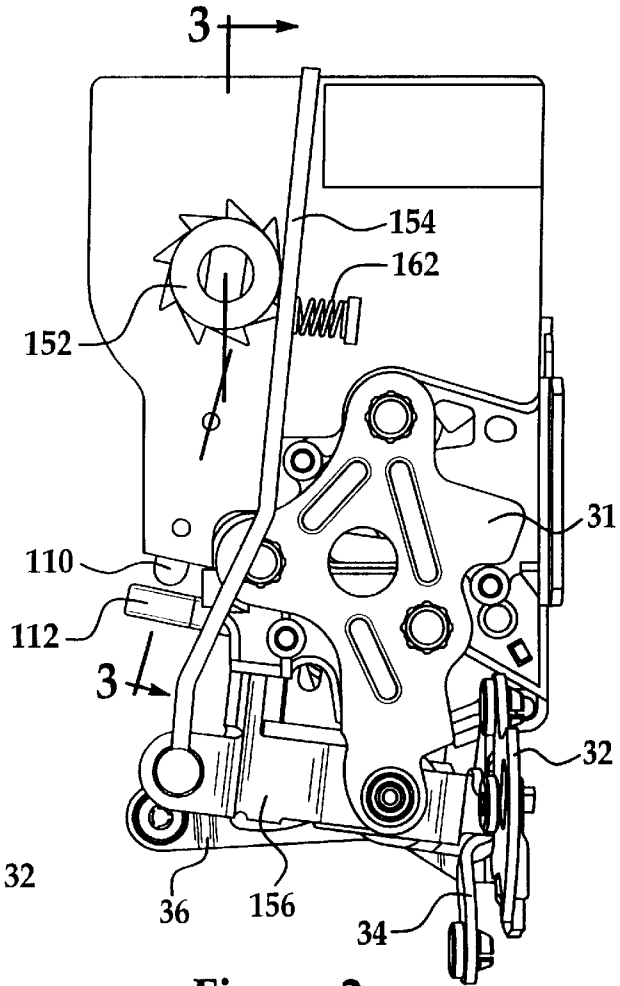
FIG. 2 is a front view of the vehicle door latch shown in FIG. 1.
Figure 1:
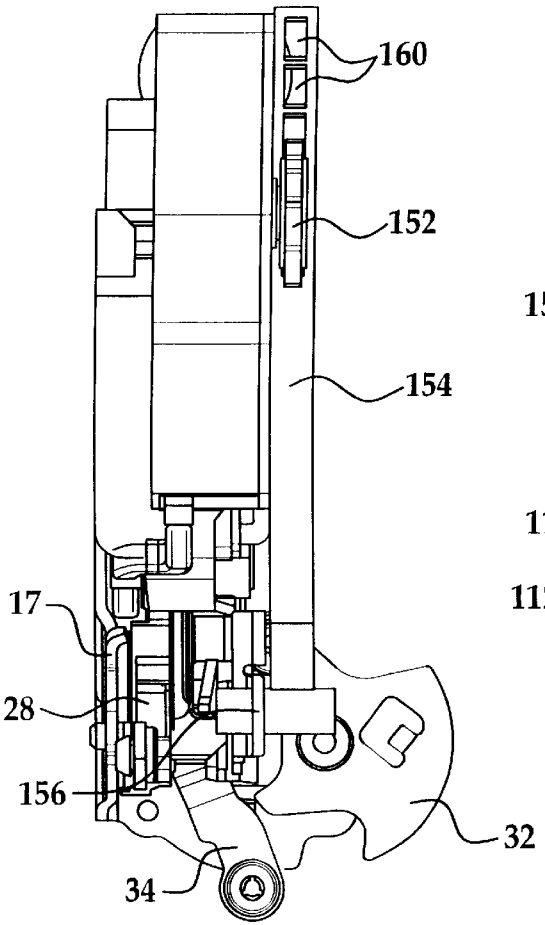
FIG. 1 is a side view of a vehicle door latch in accordance with the invention.

Referring now to FIGS. 4A and 5, the power operated release mechanism 100 is disposed in upper chamber 14 which is closed by cover plate 15. Release mechanism 100 comprises a slide 102 that extends out through a passage 17 of housing 12 that communicates with upper chamber 14. Slide 102 has an elongated slot 106 in its bottom that receives spaced guide pins 108 of housing 12 that protrude into upper chamber 14 to guide the movement of slide 102 as best shown in FIG. 3. The lower end 110 of slide 102 engages an exterior extension 112 of detent 20. The upper end 113 of slide 102 engages a rotary cam member 114 that rotates on post 116 of housing 12.

Rotary cam member 114 has a spiral shaped cam 118 at the lower end, a smooth cylindrical mid section 120 and an upper key-way 122. The spiral shaped cam 118 engages the upper end 113 of slide 102 so that slide 102 reciprocates when the rotary cam member 114 is rotated.

Rotary cam member 114 is rotated by gear wheel 124 that is journalled on the cylindrical mid section of the rotary cam member 114. Gear wheel 124 has a depending pin 126 (FIG. 3) that extends downward and engages in an open ended slot 128 in the spiral shaped cam 118 of rotary cam member 114 to drive rotary cam member 114 in the clockwise direction as shown in FIG. 4A. Gear wheel 124 also has a raised block 130 that cooperates with a rotary block lever 132 as explained below.

Gear wheel 124 is driven clockwise by an electric motor 136 via a worm gear 134 that is connected to the output of the electric motor 136 and that meshes with gear wheel 124. Electric motor 136 is unidirectional, that is, electric motor 136 rotates only in one direction when it is energized.

Rotary block out lever 132 is non-rotatably connected to a stub shaft 138 above a sector gear 140 that is also non-rotatably connected to the stub shaft 140. Sector gear 140 is in lower chamber 16 beneath the floor 141 of upper chamber 14 with stub shaft 138 projecting through an integrated journal collar 142 of floor 141. A boss 143 of sector gear 140 rides in collar 142 so that sector gear 140 meshes with gear teeth 144 of fork-bolt 18 in lower chamber 16. Fork bolt 18 thus rotates sector gear 140 and the block out lever 132 between a block out position and a by-pass position. Fork bolt 18 locates the block out lever 132 in the block out position via sector gear 140 when the fork bolt 18 is in the unlatched position and locates the block out lever 132 in the by-pass position when the fork bolt 18 is in the latched position shown in FIG. 5. When in the block out position (not shown), the block out lever 132 engages the raised block 130 of gear wheel 124 to stop rotation of gear wheel 124 in the clockwise direction. The raised block 130 of gear wheel 124 by-passes the block out lever 132 and rotates freely in the clockwise direction when the block out lever 132 is in the by-pass position shown in FIG. 5.

The power operated release mechanism operates in the following manner. Referring to FIGS. 4A, 4B and 5 and assuming that the door latch 10 is latched as shown in FIG. 5, electric motor 136 is energized rotating gear wheel 124 clockwise. Depending pin 126 of gear wheel 124 engages the closed end of slot 128 and rotates rotary cam member 114 clockwise pushing slide 102 down. Slide 102 rotates detent 20 counter-clockwise disengaging catch 22 from latch shoulder 24 which releases forkbolt 18. When forkbolt 18 is released and rotated counter-clockwise to the unlatch position (by opening the vehicle door), forkbolt 18 rotates sector gear 140 clockwise. Sector gear 140 in turn rotates block-out lever 132 which is drivingly attached to it clockwise into the path of raised block 130. When block 130 engages hook 133 of block-out lever 132, the rotation of gear wheel 124 is stopped. This stalls electric motor 136 which shuts down in response.

Subsequent closure of the vehicle door resets the power operated release mechanism 100 because forkbolt 20 is rotated clockwise to the latched position shown in FIG. 5 by the striker when the vehicle door is closed. Forkbolt 20 in turn rotates sector gear 140 and block-out lever 132 counterclockwise to the by-pass position where block-out lever 132 is out of the path of raised block 130 as shown in FIG. 5. Thus gear wheel 124 is ready to be rotated clockwise when electric motor 136 is energized to unlatch door latch 10.

The vehicle door latch 10 includes a mechanical override mechanism 150 for unlatching the door latch 10 in the event of a power failure. The mechanical override mechanism 150 comprises a ratchet wheel 152 that is drivingly connected to key way 122 at the upper end of rotary cam member 114, and a manual release lever 154. The manual release lever 154 has a series of windows 160 in its upper end that is biased into engagement with ratchet wheel 152 by a spring 162 as best shown in FIGS. 1, 2, 3 and 4A. In this particular instance, the lower end of manual release lever 154 is pivotally connected to an outside unlatching lever 156 that is part of a conventional manually operated unlatching mechanism. When unlatching lever 156 is rotated counterclockwise as part of the conventional unlatching mechanism, outside unlatching lever 156 rotates transfer lever 158 counterclockwise. Transfer lever 158 in turn either engages tab 31 and pulls detent 20 down when intermittent lever 26 is in the unlocked position shown in FIG. 5 or bypasses tab 31 when intermittent lever 26 is in the locked position as indicated above.

When unlatching lever 156 is rotated counterclockwise as part of the mechanical override mechanism 150, release lever 154 is pulled down rotating ratchet wheel 152 and rotary cam member 114 counterclockwise which moves detent 20 to the release position via slide 102 as described above. Thus outside unlatching lever 156 releases fork bolt 18 even when intermittent lever 26 is in the locked position. Hence, the outside unlatching lever 156 must be decoupled from the transfer lever 158 to maintain a locking function if the invention is used with a door latch of the type disclosed in the Garwood '563 patent. Alternatively, another unlatching lever that is operatively connected to release lever 154 can be used. In either event, the operation of the unlatching lever that is connected to the release lever 154 must be restricted in some way to maintain a locking function. For instance, the unlatching lever could be operated by a lockable outside handle or a handle located in a lockable trunk.

While the invention has be described in connection with a door latch that includes a conventional mechanically operated release mechanism and an independent mechanically operated lock mechanism, these two mechanically operated mechanisms are redundant and can be eliminated resulting in a greatly simplified door latch with considerably fewer moving parts. In other words, many modifications and variations of the present invention in light of the above teachings may be made. It is therefore, to be understood that within the scope of the appended claims the invention may be practices otherwise that as specifically described.

What is claimed is:

1. A vehicle door latch having a forkbolt that moves between a latched position and an unlatched position, a detent that moves between a latched position holding the forkbolt in the latched position and a release position allowing the forkbolt to move to the unlatched position, the detent being spring biased to the latched position, and a power operated release mechanism for moving the detent from the latched position to the release position, the power operated release mechanism comprising:

a separate slide that engages the detent at one end, a rotary cam that engages an opposite end of the slide so that the slide reciprocates linearly when the rotary cam is rotated, an electric motor that is operatively connected to the cam to rotate the cam in one direction, the electric motor being operatively connected to the cam by a gear set including a gear wheel that is concentric with the rotary cam and that has an eccentric pin engaging the rotary cam to drive the rotary cam in the one direction, a rotary block-out lever that rotates between a by-pass position and a block-out position where the block-out lever engages a shoulder of the gear wheel to stop rotation of the gear wheel, the rotary block-out lever being drivingly connected to the forkbolt so that the rotary block-out lever is rotated to the by-pass position when the forkbolt is moved to the latched position.

2. A vehicle door latch having a forkbolt that moves between a latched position and an unlatched position, a detent that moves between a latched position holding the forkbolt in the latched position and a release position allowing the forkbolt to move to the unlatched position, the detent being spring biased to the latched position, and a power operated release mechanism for moving the detent from the latched position to the release position, the power operated release mechanism comprising:

a slide that engages the detent at one end, a rotary cam that engages an opposite end of the slide so that the slide reciprocates when the rotary cam is rotated, an electric motor that is operatively connected to the cam to rotate the cam in one direction, the electric motor being operatively connected to the cam by a gear set including a gear wheel that is concentric with the rotary cam and that has a pin engaging the rotary cam to drive the rotary cam in the one direction, a rotary block-out lever that rotates between a by-pass position and a block-out position where the block-out lever engages a shoulder of the gear wheel to stop rotation of the gear wheel, the rotary block-out lever being drivingly connected to the forkbolt so that the rotary block-out lever is rotated to the by-pass position when the forkbolt is moved to the latched position, and a mechanical override mechanism comprising a ratchet wheel that is concentrically and non-rotatably attached to the rotary cam and a manual release lever that cooperates with the ratchet wheel to rotate the rotary cam to unlatch the vehicle door latch.

3. A vehicle door latch having a forkbolt that moves between a latched position and an unlatched position, a detent that moves between a latched position holding the forkbolt in the latched position and a release position allowing the forkbolt to move to the unlatched position, the detent being spring biased to the latched position, and a power operated release mechanism for moving the detent from the latched position to the release position, the power operated release mechanism comprising:

a slide that engages the detent at one end, a rotary cam member that has a spiral shaped cam that engages an opposite end of the slide so that the slide reciprocates when the rotary cam is rotated, an electric motor that is operatively connected to the rotary cam member to rotate the cam in one direction, the electric motor being operatively connected to the cam by a gear set including a gear wheel that is concentric with the rotary cam member that has a pin engaging a closed end in open ended circumferential slot of the cam to drive the cam in the one direction, a rotary block-out lever that rotates between a by-pass position and a block-out position where the block-out lever engages a raised shoulder of the gear wheel to stop rotation of the gear wheel, the rotary block-out lever being drivingly connected to the fork bolt so that the rotary block-out lever is rotated to the by-pass position when the forkbolt is moved to the latched position.

4. The vehicle door latch as defined in claim 3 further including a mechanical override mechanism comprising a ratchet wheel that is concentrically and non-rotatably attached to the rotary cam member, and a manual release lever that cooperates with the ratchet wheel to rotate the rotary cam to unlatch the vehicle door latch.

5. A vehicle door latch having a forkbolt that moves between a latched position and an unlatched position, a detent that moves between a latched position holding the forkbolt in the latched position and a release position allowing the forkbolt to move to the unlatched position, the detent being spring biased to the latched position, and a power operated release mechanism for moving the detent from the latched position to the release position, the power operated release mechanism comprising:

a slide that engages the detent at one end, a rotary cam member having a spiral shaped cam that engages at a lower end that engages an opposite end of the slide so that the slide reciprocates when the rotary cam member is rotated, an electric motor that is operatively connected to the cam member to rotate the cam in one direction, the electric motor being operatively connected to the cam by a gear set including a gear wheel that is rotatably mounted on a cylindrical portion of the rotary cam member above the spiral shaped cam, the gear wheel having a depending pin engaging a closed end in an open ended circumferential slot of the spiral shaped cam to drive the rotary cam member in the one direction, a sector gear drivingly engaging the forkbolt, a rotary block-out lever attached to the sector gear and rotatable therewith between a by-pass position and a block-out position where the block-out lever engages a raised shoulder of the gear wheel to stop rotation of the gear wheel, the rotary block-out lever being rotated to the block-out position by the sector gear when the forkbolt is moved to the unlatched position.

6. The vehicle door latch as defined in claim 5 further including a mechanical override mechanism comprising a ratchet wheel that is concentrically and non-rotatably attached to the rotary cam member above the gear wheel, a manual release lever that engages the ratchet wheel at one end to rotate the rotary cam member to unlatch the vehicle door latch, the manual release lever being pivotally attached to an unlatching lever at the opposite end, and a spring biasing the one end of the manual release lever into engagement with the ratchet wheel.

7. The vehicle door latch as defined in claim 1 wherein the gear wheel is driven by the electric motor.

* * * * *